US010395636B2

(12) United States Patent
Kim et al.

(10) Patent No.: US 10,395,636 B2
(45) Date of Patent: Aug. 27, 2019

(54) ELECTRONIC DEVICE AND METHOD OF CONTROLLING THE SAME

(71) Applicant: Samsung Electronics Co., Ltd., Gyeonggi-do (KR)

(72) Inventors: Jeong-in Kim, Gyeonggi-do (KR); Sang-soon Lim, Seoul (KR); Jun-sik Jeong, Seoul (KR)

(73) Assignee: Samsung Electronics Co., Ltd (KR)

( * ) Notice: Subject to any disclaimer, the term of this patent is extended or adjusted under 35 U.S.C. 154(b) by 0 days.

(21) Appl. No.: 15/800,931

(22) Filed: Nov. 1, 2017

(65) Prior Publication Data

US 2018/0151169 A1 May 31, 2018

(30) Foreign Application Priority Data

Nov. 25, 2016 (KR) ..... 10-2016-0158051

(51) Int. Cl.
*G10K 11/178* (2006.01)
*H04R 1/32* (2006.01)
*H04R 3/00* (2006.01)

(52) U.S. Cl.
CPC ..... *G10K 11/178* (2013.01); *G10K 11/17823* (2018.01); *G10K 11/17854* (2018.01); *G10K 11/17873* (2018.01); *H04R 1/32* (2013.01); *H04R 3/005* (2013.01); *G10K 2210/12821* (2013.01); *G10K 2210/3016* (2013.01); *G10K 2210/3046* (2013.01); *H04R 2410/07* (2013.01); *H04R 2430/25* (2013.01); *H04R 2499/13* (2013.01)

(58) Field of Classification Search
CPC ..... G10K 2210/3046; G10K 11/178; G10K 11/17823; G10K 11/17873; G10K 2210/12821; G10K 2210/128
USPC ..... 381/71.1–71.14, 71.11, 71.4
See application file for complete search history.

(56) References Cited

U.S. PATENT DOCUMENTS

| | | | | |
|---|---|---|---|---|
| 5,548,652 | A | 8/1996 | Fujiwara et al. | |
| 9,245,519 | B2 * | 1/2016 | Klug | G10K 11/178 |
| 9,872,104 | B2 * | 1/2018 | Hopkins | F04D 29/663 |
| 10,152,962 | B2 * | 12/2018 | MacNeille | H04R 1/1083 |

(Continued)

FOREIGN PATENT DOCUMENTS

| | | |
|---|---|---|
| JP | 3370115 | 11/2002 |
| JP | 2004007039 | 1/2004 |

(Continued)

OTHER PUBLICATIONS

PCT/ISA/210 Search Report issued on PCT/KR2017/005922 (pp. 3).
PCT/ISA/237 Written Opinion issued on PCT/KR2017/005922 (pp. 8).

*Primary Examiner* — Disler Paul
(74) *Attorney, Agent, or Firm* — The Farrell Law Firm, P.C.

(57) ABSTRACT

An electronic device is provided. The electronic device includes an audio module including a plurality of audio reception units and a plurality of audio output units and a processor electrically connected to the audio module and configured to receive sound via the plurality of audio reception units, generate antiphase signals based on waveforms of the received sound, determine directions in which to emit the antiphase signals, based on locations of the plurality of audio reception units, and emit the antiphase signals via the plurality of audio output units.

17 Claims, 11 Drawing Sheets

(56) References Cited

U.S. PATENT DOCUMENTS

| | | | | |
|---|---|---|---|---|
| 2003/0215099 | A1* | 11/2003 | Daly | G10K 11/178 381/71.1 |
| 2014/0233748 | A1* | 8/2014 | Klug | G10K 11/178 381/71.4 |
| 2015/0063583 | A1* | 3/2015 | Ni | G10K 11/17885 381/71.6 |
| 2015/0127351 | A1 | 5/2015 | Buck et al. | |
| 2015/0243272 | A1* | 8/2015 | Ozluturk | G10K 11/175 381/71.6 |
| 2016/0012827 | A1* | 1/2016 | Alves | G10K 11/1783 381/71.1 |
| 2016/0300562 | A1* | 10/2016 | Goldstein | G10K 11/17815 |
| 2017/0193975 | A1* | 7/2017 | Butts | G10L 21/0216 |
| 2017/0213541 | A1* | 7/2017 | MacNeille | H04R 1/1083 |

FOREIGN PATENT DOCUMENTS

| | | |
|---|---|---|
| KR | 10-2010-0084375 | 7/2010 |
| KR | 10-2011-0097267 | 8/2011 |
| KR | 10-2012-0062527 | 6/2012 |
| KR | 10-2012-0079648 | 7/2012 |

* cited by examiner

ELECTRONIC DEVICE AND METHOD OF CONTROLLING THE SAME

PRIORITY

This application claims priority to Korean Patent Application Serial No. 10-2016-0158051, which was filed in the Korean Intellectual Property Office on Nov. 25, 2016, the entire disclosure of which is incorporated herein by reference.

BACKGROUND

1. Field of the Disclosure

The present disclosure relates, generally, to a method for controlling an electronic device, and more particularly, to a method for controlling an electronic device by adaptively offsetting sound generated in distinguished regions.

2. Description of the Related Art

Various methods have been used to remove noise picked up by an electronic device. Among them, a widely used noise canceling method can include removing noise by receiving generated noise via a microphone of the electronic device, generating an antiphase signal having the same wavelength and period as the noise, but an inverted phase compared to the noise, and outputting the antiphase signal via a speaker of the electronic device.

Such a noise canceling method can be applied to, for example, headphones, to remove noise generated around the headphones while maintaining sound provided by electronic devices connected to the headphones. Accordingly, users are able to listen to desired music without noise.

A method of generating an antiphase signal with respect to noise collected via a microphone and outputting the antiphase signal via a speaker in order to remove noise generated while a subway train is entering and passing through a subway station is also well known.

SUMMARY

An aspect of the present disclosure provides an electronic device that identifies a point where noise is generated, generates an antiphase signal based on the noise, and outputs the antiphase signal in order to remove or reduce the noise, and methods of controlling the electronic devices.

An aspect of the present disclosure provides an electronic device that generates antiphase signals corresponding to noise generated at a plurality of locations and respectively emits the generated antiphase signals toward the plurality of locations, and methods of controlling the electronic devices.

In accordance with an aspect of the present disclosure, there is provided an electronic device. The electronic device includes an audio module including a plurality of audio reception units and a plurality of audio output units and a processor electrically connected to the audio module and configured to receive sound via the plurality of audio reception units, generate antiphase signals based on waveforms of the received sound, determine directions in which to emit the antiphase signals, based on locations of the plurality of audio reception units, and emit the antiphase signals via the plurality of audio output units.

In accordance with an aspect of the present disclosure, there is provided a method of controlling an electronic device. The method includes receiving sound via a plurality of audio reception units, generating antiphase signals based on waveforms of the received sound, determining directions in which to emit the antiphase signals based on locations of the plurality of audio reception units, and emitting the antiphase signals via the plurality of audio output units.

In accordance with an aspect of the present disclosure, there is provided a non-transitory recording medium having stored therein commands for executing a method of controlling an electronic device. The method includes generating antiphase signals based on waveforms of sound received via a plurality of audio reception units, determining directions in which to emit the antiphase signals based on locations of the plurality of audio reception units, and emitting the antiphase signals via a plurality of audio output units.

BRIEF DESCRIPTION OF THE DRAWINGS

The above and other aspects, features, and advantages of certain embodiments of the present disclosure will be more apparent from the following detailed description taken in conjunction with the accompanying drawings, in which.

DETAILED DESCRIPTION

Figure 1:
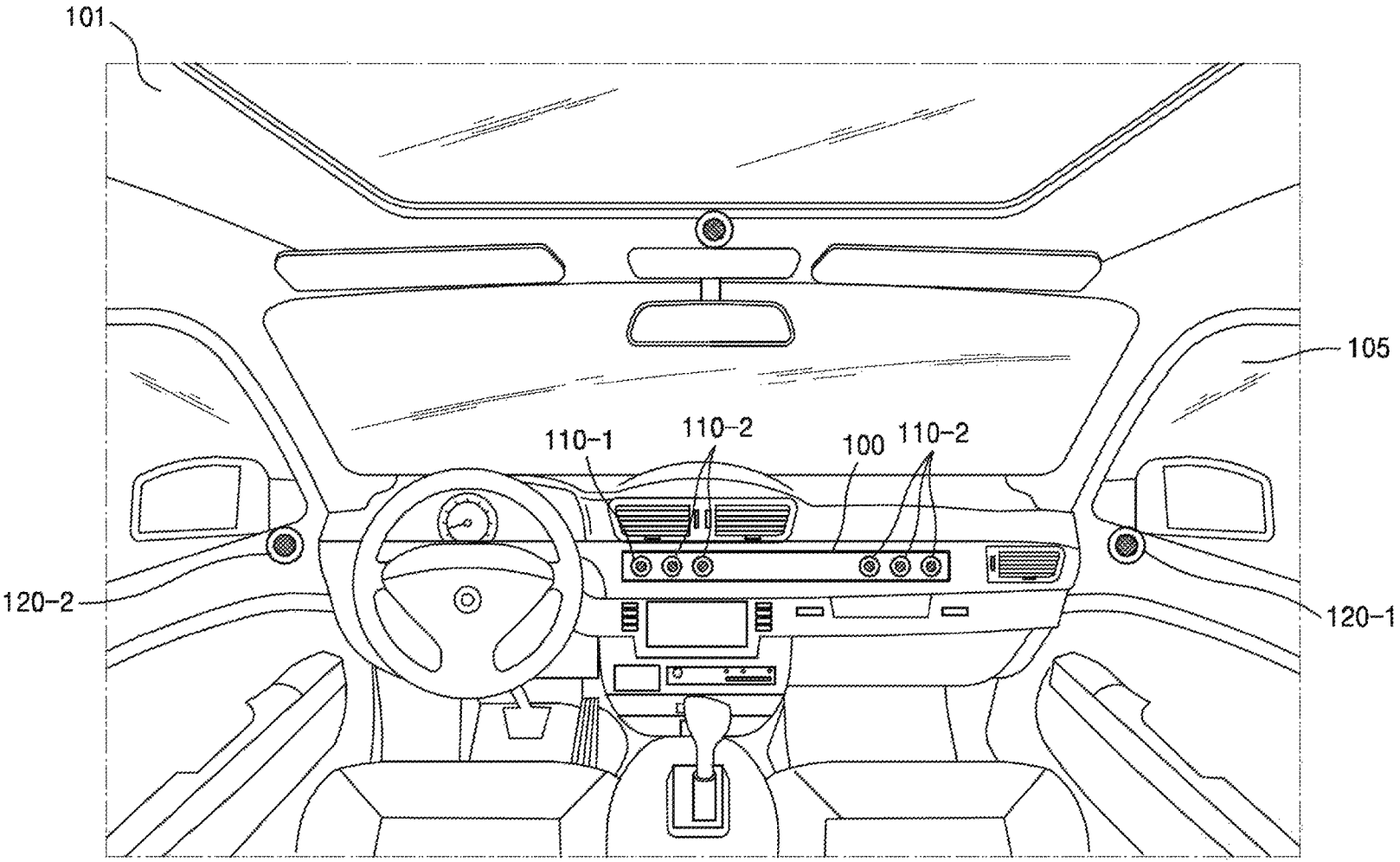
FIG. 1 is a diagram illustrating an operation of an electronic device, according to an embodiment of the present disclosure.

Embodiments of the present disclosure will be described herein below with reference to the accompanying drawings.

However, the embodiments of the present disclosure are not limited to the specific embodiments and should be construed as including all modifications, changes, equivalent devices and methods, and/or alternative embodiments of the present disclosure.

The terms "have," "may have," "include," and "may include" as used herein indicate the presence of corresponding features (e.g., elements such as numerical values, functions, operations, or parts), and do not preclude the presence of additional features.

The terms "A or B," "at least one of A or/and B," or "one or more of A or/and B" as used herein include all possible combinations of items enumerated with them. For example, "A or B," "at least one of A and B," or "at least one of A or B" means (1) including at least one A, (2) including at least one B, or (3) including both at least one A and at least one B.

The terms such as "first" and "second" as used herein may modify various elements regardless of an order and/or importance of the corresponding elements, and do not limit the corresponding elements. These terms may be used for the purpose of distinguishing one element from another element. For example, a first user device and a second user device may indicate different user devices regardless of the order or importance. For example, a first element may be referred to as a second element without departing from the scope the present invention, and similarly, a second element may be referred to as a first element.

When an element (e.g., a first element) is "(operatively or communicatively) coupled with/to" or "connected to" another element (e.g., a second element), the first element may be directly coupled with/to the second element, or there may be an intervening element (e.g., a third element) between the first element and the second element. To the contrary, when the first element is "directly coupled with/to" or "directly connected to" the second element, there is no intervening element between the first element and the second element.

The expression "configured to (or set to)" as used herein may be used interchangeably with "suitable for," "having the capacity to," "designed to," "adapted to," "made to," or "capable of" according to a context. The term "configured to (set to)" does not necessarily mean "specifically designed to" in a hardware level. Instead, the expression "apparatus configured to . . . " may mean that the apparatus is "capable of . . . " along with other devices or parts in a certain context. For example, "a processor configured to (set to) perform A, B, and C" may mean a dedicated processor (e.g., an embedded processor) for performing a corresponding operation, or a generic-purpose processor (e.g., a central processing unit (CPU) or an application processor) capable of performing a corresponding operation by executing one or more software programs stored in a memory device.

The term "module" as used herein may be defined as, for example, a unit including one of hardware, software, and firmware or two or more combinations thereof. The term "module" may be interchangeably used with, for example, the terms "unit", "logic", "logical block", "component", or "circuit", etc. A "module" may be a minimum unit of an integrated component or a part thereof. A "module" may be a minimum unit performing one or more functions or a part thereof. A "module" may be mechanically or electronically implemented. For example, a "module" may include at least one of an application-specific integrated circuit (ASIC) chip, field-programmable gate arrays (FPGAs), or a programmable-logic device, which is well known or will be developed in the future, for performing certain operations.

The terms used in describing the various embodiments of the present disclosure are for the purpose of describing particular embodiments and are not intended to limit the present disclosure. As used herein, the singular forms are intended to include the plural forms as well, unless the context clearly indicates otherwise. All of the terms used herein including technical or scientific terms have the same meanings as those generally understood by an ordinary skilled person in the related art unless they are defined otherwise. The terms defined in a generally used dictionary should be interpreted as having the same or similar meanings as the contextual meanings of the relevant technology and should not be interpreted as having ideal or exaggerated meanings unless they are clearly defined herein. According to circumstances, even the terms defined in this disclosure should not be interpreted as excluding the embodiments of the present disclosure.

Electronic devices according to the embodiments of the present disclosure may include smart phones, tablet personal computers (PCs), mobile phones, video telephones, electronic book readers, desktop PCs, laptop PCs, netbook computers, workstations, servers, personal digital assistants (PDAs), portable multimedia players (PMPs), Motion Picture Experts Group (MPEG-1 or MPEG-2) Audio Layer 3 (MP3) players, mobile medical devices, cameras, or wearable devices. For example, the wearable devices may include accessory-type wearable devices (e.g., watches, rings, bracelets, anklets, necklaces, glasses, contact lenses, or head-mounted-devices (HMDs)), fabric or clothing integral wearable devices (e.g., electronic clothes), body-mounted wearable devices (e.g., skin pads or tattoos), or implantable wearable devices (e.g., implantable circuits).

The electronic devices may be smart home appliances. The smart home appliances may include televisions (TVs), digital versatile disk (DVD) players, audios, refrigerators, air conditioners, cleaners, ovens, microwave ovens, washing machines, air cleaners, set-top boxes, home automation control panels, security control panels, TV boxes (e.g., Samsung HomeSync™, Apple TV™, or Google TV™), game consoles (e.g., Xbox™ and PlayStation™), electronic dictionaries, electronic keys, camcorders, or electronic picture frames.

The electronic devices may include various medical devices (e.g., various portable medical measurement devices (such as blood glucose meters, heart rate monitors, blood pressure monitors, or thermometers, etc.), magnetic resonance angiography (MRA) devices, magnetic resonance imaging (MRI) devices, computed tomography (CT) devices, scanners, ultrasonic devices, etc.), navigation devices, global positioning system (GPS) receivers, event data recorders (EDRs), flight data recorders (FDRs), vehicle infotainment devices, electronic equipment for vessels (e.g., navigation systems, gyrocompasses, etc.), avionics, security devices, head units for vehicles, industrial or home robots, automatic teller machines (ATMs), point of sales (POSs) devices, or Internet of Things (IoT) devices (e.g., light bulbs, various sensors, electric or gas meters, sprinkler devices, fire alarms, thermostats, street lamps, toasters, exercise equipment, hot water tanks, heaters, boilers, etc.).

The electronic devices may further include at least one of parts of furniture or buildings/structures, electronic boards, electronic signature receiving devices, projectors, or various measuring instruments (such as water meters, electricity meters, gas meters, or wave meters, etc.). The electronic devices may be flexible electronic devices.

The electronic devices may be one or more combinations of the above-mentioned devices. Also, the electronic devices are not limited to the above-mentioned devices, and may include new electronic devices according to the development of new technologies.

Herein, the term "user" may refer to a person who uses an electronic device or may refer to a device (e.g., an artificial intelligence electronic device) which uses an electronic device.

FIG. 1 is a diagram of an electronic device 100, according to an embodiment of the present disclosure. The electronic device 100 receives sound or audio and then offsets the received sound or audio.

The electronic device 100 may be implemented, for example, as a mobile phone, a smartphone, a laptop computer, a tablet device, an e-book device, a digital broadcasting device, a PDA, a PMP, a navigation, or a wearable device (e.g., a smart watch, smart glasses, an HMD). The electronic device 100 may be implemented as an audio device mounted to a transport apparatus 101. The audio device 100 may include a plurality of audio output units 110-1-110-2 and a plurality of audio reception units 120-1-120-2. The audio output units 110-1-110-2 may be, for example, speakers, and the audio reception units 120-1-120-2 may be, for example, microphones.

The audio reception units 120-1-120-2 may be mounted at various locations on the transport apparatus 101, and the audio reception units 120-1-120-2 may be located at places where noise is likely to be generated. For example, the audio reception units 120-1-120-2 may be mounted adjacent to areas where the windows of the transport apparatus 101 open. The audio device 100 may know the locations in or on the transport apparatus 101 where the audio reception units 120-1-120-2 are mounted. The audio reception units 120-1-120-2 may receive sound (e.g., sound signals) introduced into the transport apparatus 101 via the windows when the windows of the transport apparatus 101 are in an open state, a closed state, or while the windows are being opened or closed.

The audio device 100 may control each of the plurality of audio output units 110-1-110-2. For example, the audio device 100 may control the audio output unit 110-1 to output music and control other audio output unit 110-2 to not output music.

The audio device 100 may control directions in which the plurality of audio output units 110-1-110-2 output music. The audio device 100 may control directions in which the audio output units 110-1-110-2 output audio, by using a motor and a link structure. However, embodiments are not limited thereto. For example, the audio device 100 may control directions in which the audio output units 110-1-110-2 output music, by using a beam forming technique.

The audio device 100 may generate antiphase signals of the sound received via the audio reception units 120-1-120-2 and emit the antiphase signals in the form of sound waves via the audio output units 110-1-110-2. Sound introduced into the transport apparatus 101 via the windows may be overlapped by the sound waves having the antiphase signals and thus be offset.

When a window 105 on the passenger side of the transport apparatus 101 is open, the audio device 100 may receive sound that enters the transport apparatus 101, via the audio reception unit 120-1 mounted adjacent to the window 105 on the passenger side. The audio device 100 may generate an antiphase signal of the received sound and may emit the antiphase signal in the form of a sound wave via the audio output units 110-1-110-2.

The audio device 100 may control the antiphase signal in the form of a sound wave to be emitted toward the window 105 on the passenger side. Sound introduced into the transport apparatus 101 via the window 105 on the passenger side may be met by the antiphase signal and may be offset. Accordingly, the transport apparatus 101 may minimize the sound introduced via the window 105 on the passenger side, while maintaining inflow of external air.

Figure 2A:
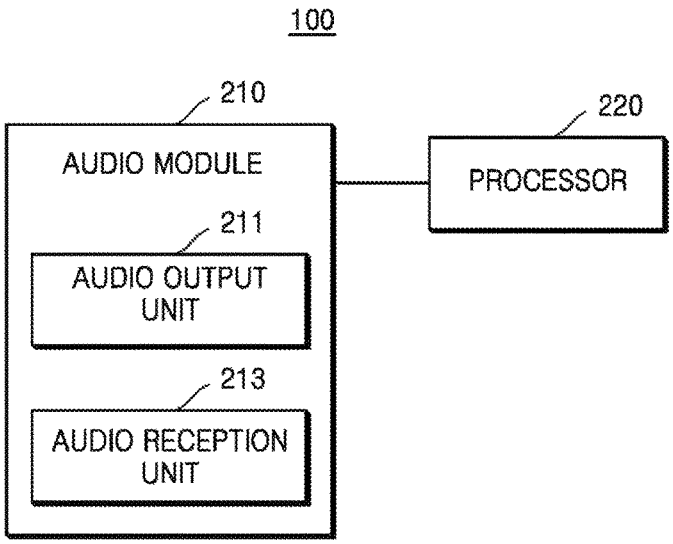
FIGS. 2A and 2B illustrate an electronic device, according to an embodiment of the present disclosure.
Figure 2B:
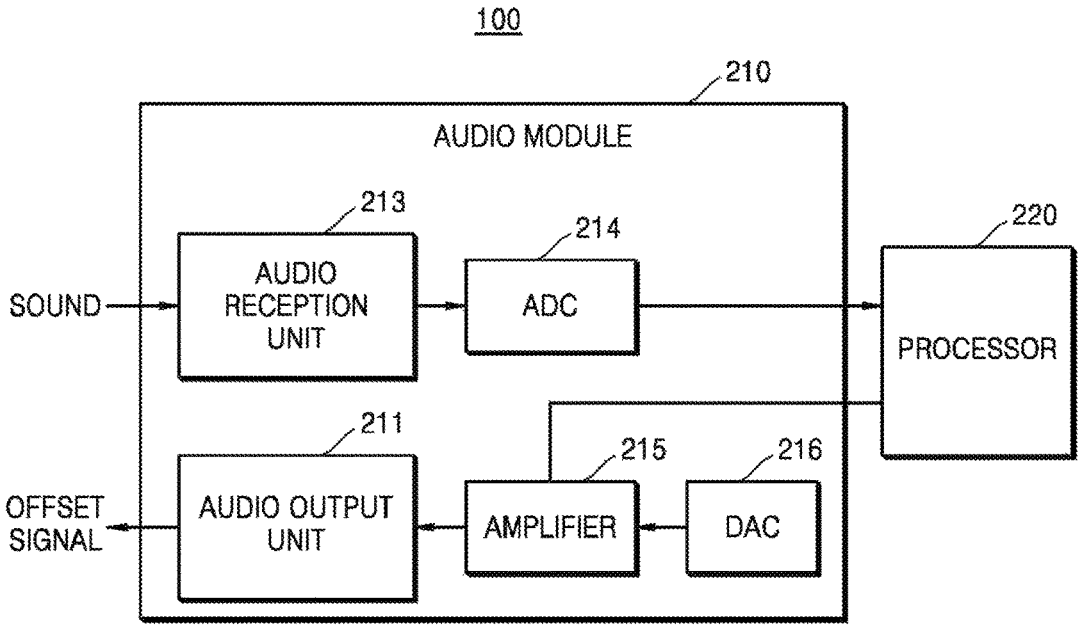

FIGS. 2A and 2B are schematic block diagrams of the electronic device 100, according to an embodiment of the present disclosure.

Referring to FIG. 2A, the electronic device 100 may include an audio module 210 and a processor 220. The audio module 210 may include an audio output unit 211 and an audio reception unit 213. The components included in the electronic device 100 illustrated in FIG. 2A are optional, and thus, the number of components included in the electronic device 100 may differ. For example, the electronic device 100 may include, as an input module, e.g., a touch panel, a hard key, a proximity sensor, or a biometric sensor, and further, may include a power supply, a display, and a memory.

The audio module 210 may include a plurality of audio output units 211 and a plurality of audio reception units 213. The audio output units 211 and the audio reception units 213 may be electrically connected to the audio module 210. The audio output units 211 and the audio reception units 213 may be mounted apart from each other and communicate with each other wirelessly or via wired connections. The audio output units 211 and the audio reception units 213 may be electrically connected to the processor 220, or alternatively, may be mounted apart from the processor 220 and communicate with the processor 220 wirelessly or via wired connections.

The processor 220 may control an operation of the electronic device 100 and/or signal transfer among the internal components of the electronic device 100 and may process data. For example, the processor 220 may be a CPU, an application processor (AP), a micro controller unit (MCU), or a microprocessor unit (MPU). The processor 220 may be a single core processor or a multi-core processor.

The processor 220 may receive audio from a preset location via the plurality of audio reception units 213, generate an antiphase signal based on the phase of the received audio, and emit the generated antiphase signal toward the preset location via the audio output units 211.

Referring to FIG. 2B, the audio module 210 includes the audio reception units 213, an analog-to-digital converter (ADC) 214, the audio output units 211, an amplifier 215, and a digital-to-analog converter (DAC) 216. The components included in the audio module 210 illustrated in FIG. 2B are optional, and thus the number of components included in the audio module 210 may differ.

The ADC 214, the amplifier 215, and the DAC 216 may be omitted from the audio module 210 and instead may be included in the processor 220, or may be disposed in another space of the electronic device 100.

The audio reception units 213 may include microphones. The audio reception units 213 may receive sound, and the sound received via the audio reception units 213 may be in the form of an analog signal. The ADC 214 may convert the received sound from an analog signal form into a digital signal.

The processor 220 may extract a sound signal in the form of a digital signal. The processor 220 may generate a signal for offsetting the sound signal. For example, the processor 220 may generate an antiphase signal having the same period as the sound signal but having an inverted phase compared to the sound signal.

The DAC 216 may convert the antiphase signal generated by the processor 220, which is a digital signal, into an analog signal. The amplifier 215 may amplify the analog antiphase signal, based on a control signal output by the processor 220. The audio output units 211 may include speakers. The audio output units 211 may convert the analog antiphase signal received from the amplifier 215 into a sound wave and emit the sound wave.

The electronic device 100 may generate an antiphase signal for the received sound and emit the antiphase signal in the form of a sound wave to thereby offset unwanted sound.

Figure 3:
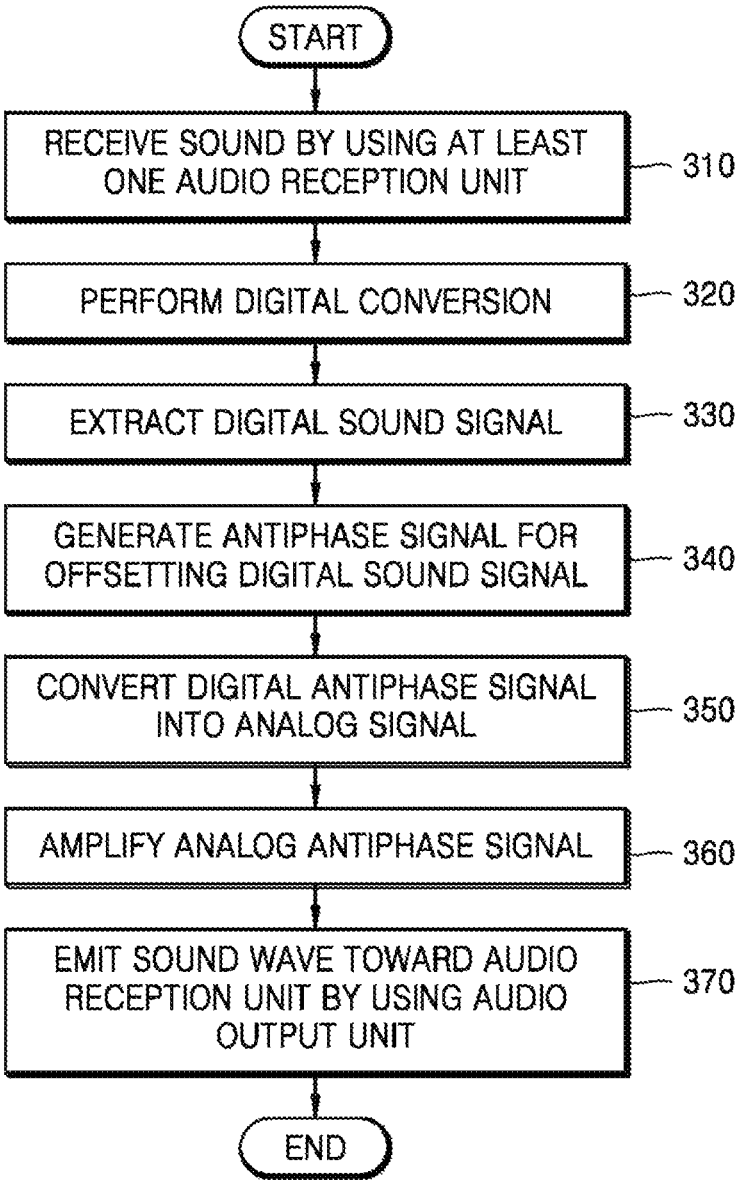
FIG. 3 is a flowchart of a method of an electronic device for receiving sound, generating an antiphase signal for offsetting the received sound, and emitting the antiphase signal in the form of a sound wave, according to an embodiment of the present disclosure.

FIG. 3 is a flowchart of a method of the electronic device 100 for receiving sound (e.g., one or more sound signals), generating an antiphase signal for offsetting the received sound, and emitting the antiphase signal in the form of a sound wave, according to an embodiment of the present disclosure.

Referring to step 310, the electronic device 100 receives sound via at least one audio reception unit. The at least one audio reception unit may be located relatively near or far from the electronic device 100.

The electronic device 100 may start receiving a sound when one or more preset conditions are satisfied, and may perform an operation for offsetting the received sound. When the preset conditions are satisfied and while receiving sound, the electronic device 100 may perform an operation for offsetting the received sound.

The preset conditions may include at least one of when an environmental state of an area around the at least one audio reception unit has changed and when a user inputs a command for receiving sound.

An environmental state of an area around the at least one audio reception unit may change when one of the windows of the transport apparatus 101 is opened while the transport apparatus 101 is in motion. The electronic device 100 may be aware of the location of the open window. When one of the windows of the transport apparatus 101 is opened, the electronic device 100 may start receiving sound via all of the audio reception units installed in the transport apparatus 101. When one of the windows of the transport apparatus 101 is opened, the electronic device 100 may receive sound via only an audio reception unit adjacent to the open window.

When a user inputs a command for receiving sound, the user may activate an audio reception unit positioned at a desired location via a touch screen included in the electronic device 100.

The electronic device 100 may satisfy the preset conditions while receiving sound and perform an operation for offsetting the received sound when the loudness of the received sound is greater than or equal to a preset value. When the loudness size of the received sound is greater than or equal to the preset value may be, for example, when the electronic device 100 is included in a transport apparatus 101, and, while all of the audio reception units are receiving sound while the transport apparatus 101 is moving, sound having a volume greater than or equal to the preset value is received from a location of a specific audio reception unit.

In the aforementioned examples, the electronic device 100 may receive sound via an audio reception unit and perform an offset operation on the received sound, or, when the electronic device 100 receives a sound louder than or equal to a preset value, the electronic device 100 may perform an offset operation on the received sound.

Referring to step 320, the electronic device 100 digitally converts the received sound. At step 330, the electronic device 100 extracts a digital sound signal. At step 340, the electronic device 100 generates an antiphase signal capable of offsetting the digital sound signal. The antiphase signal may be a signal having the same period as the sound signal and an amplitude opposite that of the sound signal. A process in which the electronic device 100 offsets the received sound by using the antiphase signal will be described in greater detail with reference to FIG. 4.

Referring to step 350, the electronic device 100 converts the digital antiphase signal into an analog signal, and at step 360, the electronic device 100 amplifies the analog antiphase signal.

Referring to step 370, the electronic device 100 converts the analog antiphase signal into a sound wave by using an audio output unit. The electronic device 100 may emit the sound wave toward the audio reception unit that received the sound in step 310. However, the direction or directions in which the electronic device 100 emits the sound wave is not limited thereto. For example, the electronic device 100 may emit the sound wave in one or more directions capable of increasing the amount in which the emitted sound wave offsets the received sound.

The electronic device 100 may output (i.e., emit) the antiphase signal in different directions by mechanically changing the direction in which the audio output unit faces. The electronic device 100 may include a gear or a link structure capable of changing the direction in which an audio output device faces.

The electronic device 100 may change the output direction of the antiphase signal by using a beam forming technique. A method in which the electronic device 100 changes the output direction of the antiphase signal by using a beam forming technique will be described in greater detail with reference to FIG. 5.

Figure 4:
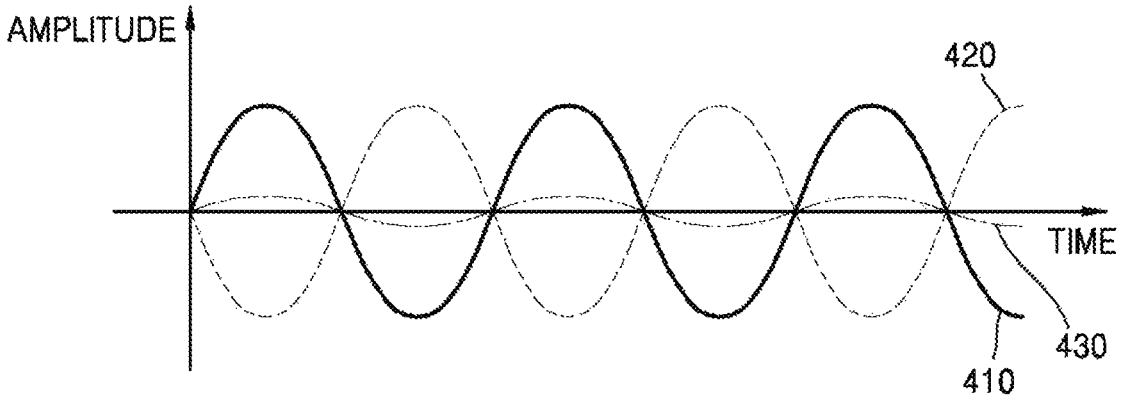
FIG. 4 is a graph illustrating a process in which an electronic device offsets a received sound by generating an antiphase signal for the received sound, according to an embodiment of the present disclosure.

FIG. 4 is a graph illustrating a process in which the electronic device offsets a received sound by generating an antiphase signal for the received sound, according to an embodiment of the present disclosure.

The electronic device 100 may express a waveform of the received sound as a first signal.

Referring to FIG. 4, the horizontal axis indicates time, and the vertical axis indicates amplitude of the received sound. A first curve 410 on the graph represents the first signal, expressing the change in amplitude over time for the sound received by the electronic device 100. The first curve 410 may have a constant period.

The electronic device 100 may generate a second signal capable of offsetting the received sound, based on the waveform of the received sound. For example, the electronic device 100 may generate a second signal having the same wavelength, the same period, and the same amplitude as the received sound but an inverted phase compared to the received sound. A second curve 420 on the graph represents the second signal.

The electronic device 100 may convert the second signal into a sound wave and emit the sound wave by using the audio output unit. The electronic device 100 may emit the sound wave via some or all of a plurality of audio output units.

The sound wave emitted by the electronic device 100 may meet or coincide with the sound received by the electronic device 100 and thus may create a destructive interference. As a result of the destructive interference, the first curve 410 and the second curve 420 may disappear, and only a third curve 430 may remain. Accordingly, the sound received by the electronic device 100 and the sound emitted by the electronic device 100 may offset one another and disappear or be relatively negligible.

Figure 5A:
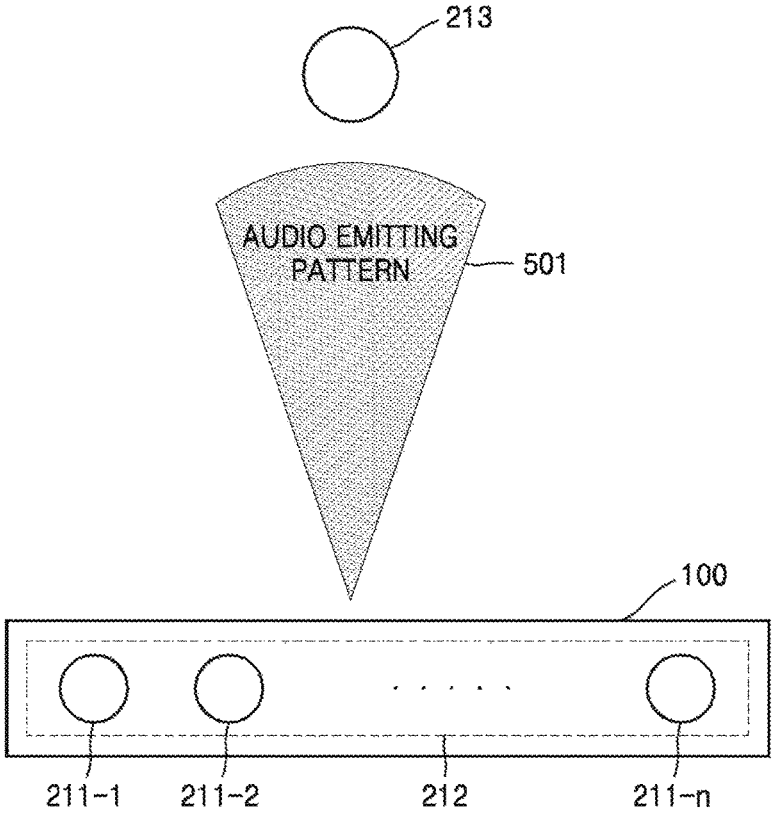
FIGS. 5A and 5B are diagrams of a method in which an electronic device emits a sound wave by using a beam forming method, according to an embodiment of the present disclosure.
Figure 5B:
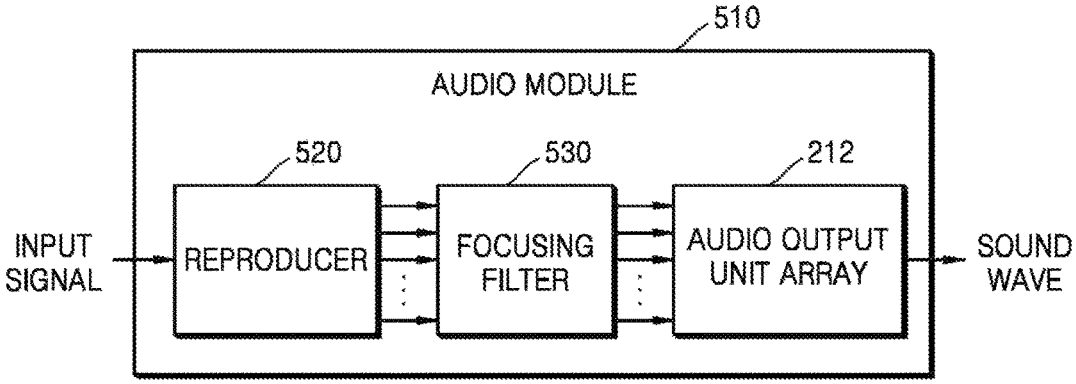

FIGS. 5A and 5B are diagrams of a method in which the electronic device 100 emits a sound wave by using a beam forming method, according to an embodiment of the present disclosure.

An audio emitting pattern 501 represents a sound field formed from audio emitted via the audio output units 211-1, 211-2, **211-*n***, etc. as a pattern. The sound field conceptually represents an area affected by sound pressure due to a sound source.

An audio emitting pattern 501 may be determined by a measurer which measures output signals. For example, the measurer may receive audio signals emitted from an array of the audio output units **211-1-211-*n* included in the electronic device 100, measure distances between the audio output units 211-1-211-*n*, and the electronic device 100**, and visually show the intensities of the audio signals on a graph according to the measured distances.

Beam forming techniques for forming the audio emitting pattern 501 in a specific direction may be roughly classified into fixed beam forming and adaptive beam forming according to use or non-use of input information.

An example of fixed beam forming is a delay and sum beamforming (DSB) technique of performing phase matching on a target signal by compensating for a time delay of respective input signals for channels. Examples of fixed beam forming further include a least mean square (LSM) method and a Dolgh-Chebyshev method. However, according to fixed signal beam forming, a weighted value of a beam former is fixed according to position and frequency of a signal and an interval between channels. Thus, fixed signal beam forming fails to adapt to a signal environment and accordingly is limited in performance.

Adaptive beam forming is designed such that a weighted value of a beam former varies according to signal environments. Representative examples of adaptive beam forming include a generalized side-lobe canceller (GSC) method and a linearly constrained minimum variance (LCMV) method. The GSC method may include a fixed beam forming and target signal blocking matrix, and a multi-interference canceller.

Referring to FIG. 5A, the electronic device 100 may include the plurality of audio output units **211-1-211-*n* arranged at equal intervals or at unequal intervals. Via an audio output unit array 212, the electronic device 100 may form the audio emitting pattern 501** in a preset direction.

Referring to FIG. 5B, an audio module 510 may include the audio module 210 of FIG. 2B. The audio module 510 may include a reproducer 520, a focusing filter 530, and the audio output unit array 212. The reproducer 520 may reproduce an input signal via the output channels of the audio output unit array 212.

The electronic device 100 may emit audio in a specific direction by using the focusing filter 530. The focusing filter 530 may be a filter for focusing a sound source on a specific location in a horizontal direction or focusing the sound source in a specific direction. The focusing filter 530 may be designed to adjust gains and delays of audio signals respectively output to the audio output units **211-1-211-*n* of the audio output unit array 212 or may be designed using a least square error (LSE) filter design method. According to the LSE filter design method, an LSE filter is designed to minimize error between a target pattern and a resultant pattern. A specific location toward which audio is focused may be referred to as a target location or a focus location. The audio output units 211-1-211-*n* may emit the same audio, except that the audio emitted by the audio output units 211-1-211-*n*** differs in phase and is directed toward a different location.

The electronic device 100 may determine an emission pattern of a sound wave and determine an output direction of the sound wave (i.e., a direction to emit the sound wave). However, other beam forming methods and/or an algorithms of a filter may be used.

Figure 6:
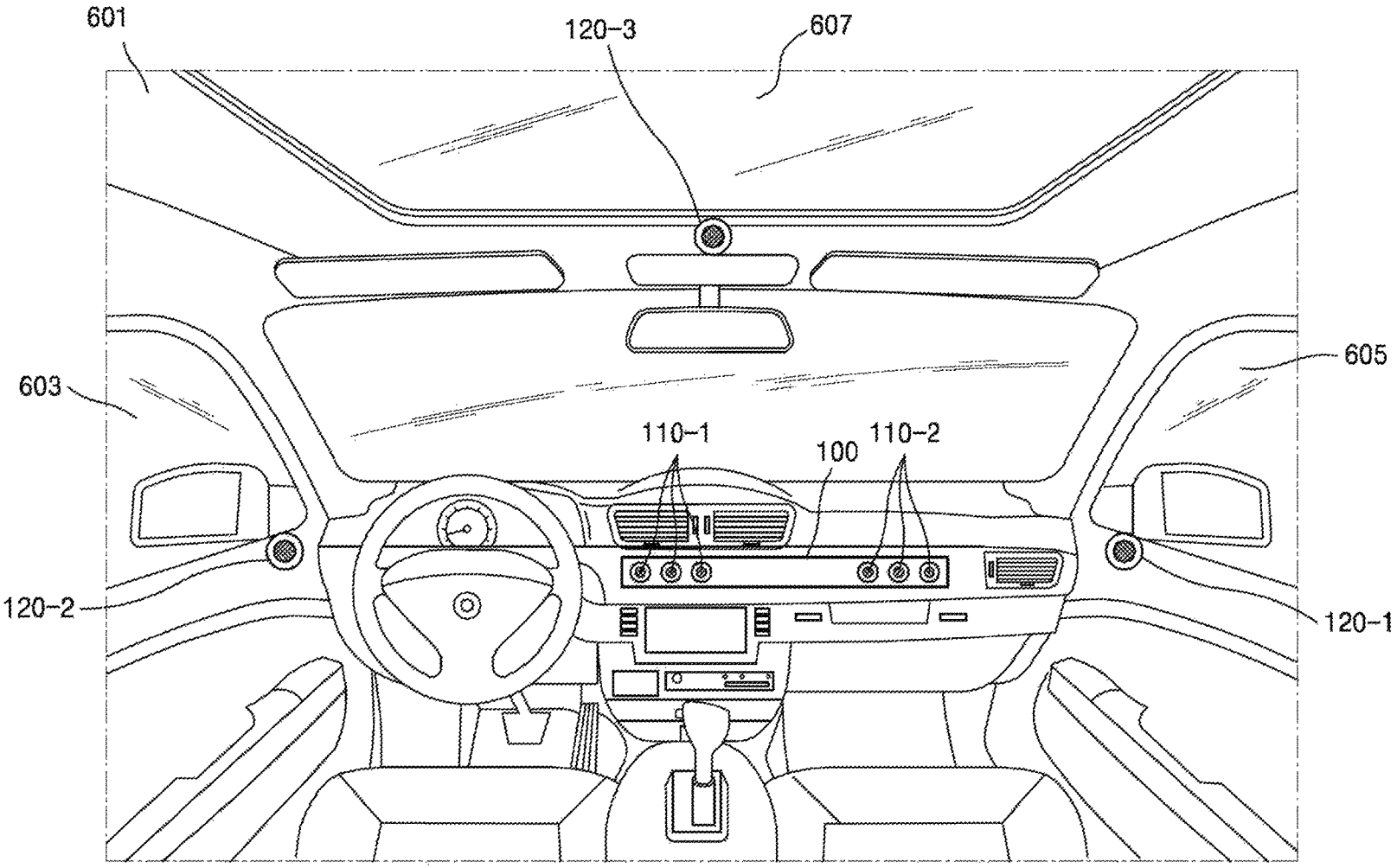
FIG. 6 is a diagram illustrating an electronic device, which removes a received sound when the electronic device is included in a transport apparatus, according to an embodiment of the present disclosure.

FIG. 6 is a diagram illustrating the electronic device 100, which removes a received sound when the electronic device is included in a transport apparatus, according to an embodiment of the present disclosure.

Referring to FIG. 6, the electronic device 100 may include an audio device mounted to a transport apparatus 601. The audio device 100 may include the plurality of audio output units 110-1-110-2 and a plurality of audio reception units 120-1-120-2.

As described above, the electronic device 100 may be implemented as a mobile phone, a smartphone, or a tablet device. The electronic device 100 may control the audio device of the transport apparatus 601 by communicating with the transport apparatus 601. The transport apparatus 601 may include the audio output units 110-1-110-2 and the audio reception units 120-1-120-2, and the electronic device 100 may be implemented as a portable terminal separate from the transport apparatus 601.

The electronic device 100 may be detachable from the transport apparatus 601. When the electronic device 100 is mounted in the transport apparatus 601, the electronic device 100 may communicate with the transport apparatus 601 via various wired communication methods. When the electronic device 100 is physically separate from the transport apparatus 601, the electronic device 100 may communicate with the transport apparatus 601 via various wireless communication methods.

Examples of the electronic device 100 being mounted as an audio device in the transport apparatus 601 will now be described.

The audio reception units 120-1-120-2 may be mounted at various locations in or on the transport apparatus 601. The audio reception units 120-1-120-2 may be mounted adjacent to a driver-seat window 603, a passenger-seat window 605, and a sun roof 607 of the transport apparatus 601. The electronic device 100 may know the locations on the transport apparatus 601 where the audio reception units 120-1-120-2 are mounted. The audio reception units 120-1-120-2 may receive sound at the locations.

The audio device 100 may generate antiphase signals of sound (e.g., sound signals) received via the audio reception units 120-1-120-2, and may emit the antiphase signals in the form of sound waves by using the audio output units 120-1-120-2, as described above with reference to FIG. 4. The received sound may be overlapped by the antiphase signals and thus be offset.

The electronic device 100 may control some the audio output unit 110-1 to output music and the audio output unit 110-2 not to output music (e.g., control audio output units 110-2 to output audio different from the music output by output units 110-1). The electronic device 100 may control directions in which the audio output units 110-1-110-2 output music or audio by using the beam forming technique described above with reference to FIG. 5.

The transport apparatus 601 may open the sun roof 607 while in motion. An audio reception unit 120-3 adjacent to the sun roof 607 may receive sound introduced into the transport apparatus 601 via the open sun roof 607. The electronic device 100 may recognize that the sun roof 607 has been opened, and may activate the audio reception unit 120-3 adjacent to the sun roof 607.

The electronic device 100 may convert the sound received by the audio reception unit 120-3 into a digital sound signal. After extracting the digital sound signal, the electronic device 100 may generate a digital antiphase signal capable of offsetting the extracted digital sound signal. The electronic device 100 may convert the digital antiphase signal into an analog antiphase signal.

The electronic device 100 may emit the analog antiphase signal in the form of a sound wave toward the audio reception unit 120-3 adjacent to the sun roof 607 via an audio output unit. Accordingly, the sound introduced via the sun roof 607 may be offset by the emitted sound wave.

The electronic device 100 may simultaneously or sequentially emit sound waves for offsetting sound signals respectively generated from a plurality of locations. The electronic device 100 may generate a first antiphase signal based on a first sound received via a first audio reception unit, generate a second antiphase signal based on a second sound received via a second audio reception unit, determine in which direction to emit the first antiphase signal, based on a location of the first audio reception unit, determine in which direction to emit the second antiphase signal, based on a location of the second audio reception unit, and simultaneously emit the first antiphase signal and the second antiphase signal via a plurality of audio output units.

The transport apparatus 601 may simultaneously open the driver-seat window 603 and the passenger-seat window 605 while in motion. In this case, the audio reception unit 120-2 adjacent to the driver-seat window 603 and audio reception unit 120-1 adjacent to the passenger-seat window 605 may receive sound introduced into the transport apparatus 601 via the opened driver-seat window 603 and the opened passenger-seat window 605. The electronic device 100 may recognize that the driver-seat window 603 and the passenger-seat window 605 have been opened, and activate the audio reception units 120-1 and 120-2. While the electronic device 100 is receiving sound via the audio reception units 120-1 and 120-2, the electronic device 100 may recognize that sound signals having a preset value or greater (e.g., sound signals having amplitudes that are greater than or equal to the preset value) are input when the driver-seat window 603 and the passenger-seat window 605 are opened.

The electronic device 100 may convert the sound introduced via the audio reception unit 120-2 adjacent to the driver-seat window 603 and the sound introduced via the audio reception unit 120-1 adjacent to the passenger-seat window 605 into digital sound signals. After extracting the digital sound signals, the electronic device 100 may generate digital antiphase signals capable of offsetting the extracted digital sound signals. The electronic device 100 may convert the digital antiphase signals into analog antiphase signals.

The electronic device 100 may emit the analog antiphase signals in the form of sound waves toward the audio reception units 120-1 and 120-2 adjacent to the driver-seat window 603 and the passenger-seat window 605 via the audio output units 110. Accordingly, the sound introduced via the driver-seat window 603 and the passenger-seat window 605 may be simultaneously or sequentially offset.

Figure 7:
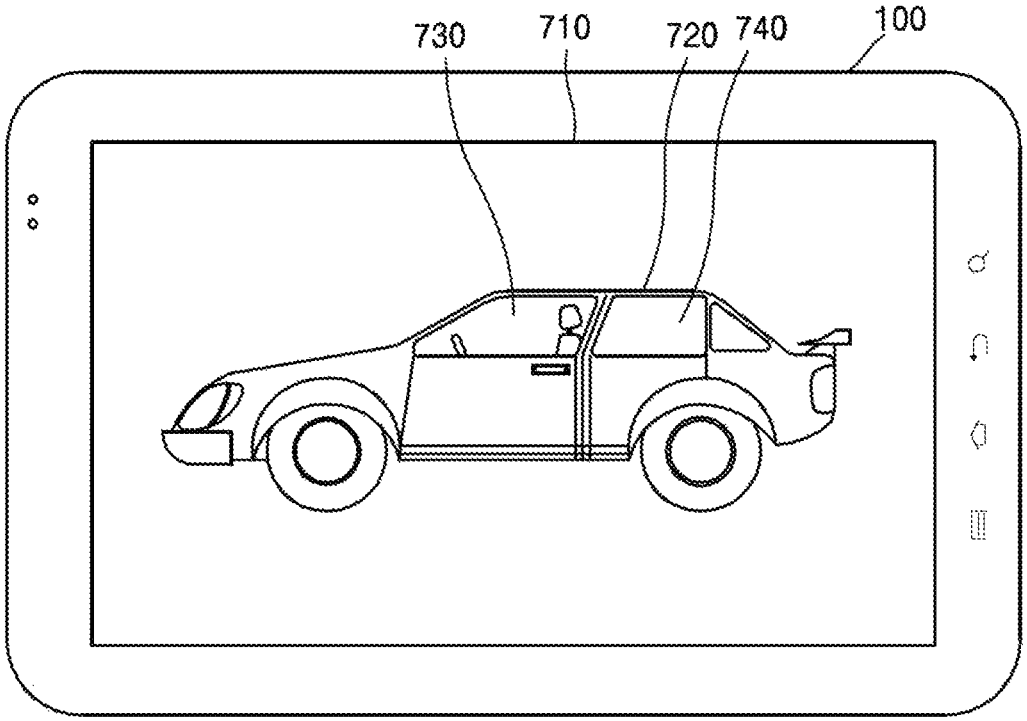
FIG. 7 is a diagram of a screen of an electronic device, which allows a user to select an audio reception unit that is to be activated, according to an embodiment of the present disclosure.

FIG. 7 is a diagram of a screen of the electronic device 100, which allows a user to select an audio reception unit that is to be activated, according to an embodiment of the present disclosure.

The user may execute a function for offsetting a received sound, and may select a location where to offset sound. For example, the electronic device 100 may display a user interface 720 indicating an outward form of the transport apparatus 101 or 601 on a display 710. The display 710 may be a touch screen. The electronic device 100 is detachable from the transport apparatus 101 or 601.

The user interface 720 may display a lateral side, a front side, and a top side of the transport apparatus 101 or 601 based on an external input signal. The user may select a region where to offset sound, by using the user interface 720.

The user may select a driver-seat window 730 of the transport apparatus 101 or 601 by touching the display 710 (e.g., by entering a touch input via the display 710). The electronic device 100 may activate an audio reception unit adjacent to the driver-seat window 730 based on the selection by the user.

The electronic device 100 may generate an antiphase signal based on sound received via the audio reception unit adjacent to the driver-seat window 730. The electronic device 100 may convert the antiphase signal into a sound wave and emit the sound wave toward the driver-seat window 730 by using audio output units.

The user may select a plurality of locations where to offset sound. For example, the user may select the driver-seat window 730 and a window 740 behind a driver seat by touching the display 710. The electronic device 100 may activate audio reception units adjacent to the driver-seat window 730 and the window 740 behind the driver seat, based on the selection by the user.

The electronic device 100 may generate respective antiphase signals based on sound respectively received from the audio reception units adjacent to the driver-seat window 730 and the window 740 behind the driver seat. The electronic device 100 may convert the antiphase signals into sound waves and emit the sound waves toward the driver-seat window 730 and the window 740 behind the driver seat by using audio output units.

The user may selectively offset sound at a desired location.

Figure 8A:
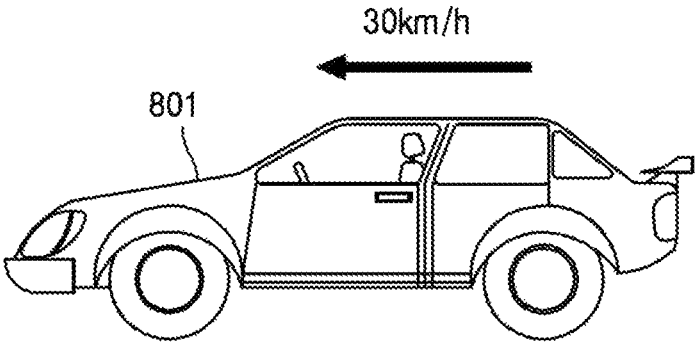
FIGS. 8A and 8B are diagrams illustrating an electronic device, which receives sound when satisfying preset conditions, according to an embodiment of the present disclosure.
Figure 8B:
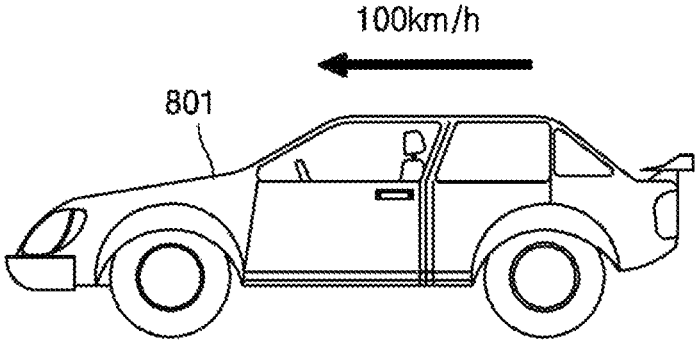

FIGS. 8A and 8B are diagrams illustrating the electronic device 100, which receives sound when satisfying preset conditions, according to an embodiment of the present disclosure.

The electronic device 100 may include an audio device mounted to a transport apparatus 801. The audio device 100 may include a plurality of audio output units and a plurality of audio reception units.

When sound received via the audio reception units is greater (e.g., louder) than or equal to a preset volume (e.g., is a sound signal having an amplitude equal to or greater than a preset value), the electronic device 100 may automatically perform an operation of offsetting the sound having the volume of the preset value or greater. The preset value may be set by a manufacturer of the electronic device 100, and a user may re-adjust the preset value.

Referring to FIG. 8A, the transport apparatus 801 may move at a speed of 30 km/h. When the transport apparatus 801 is in motion, sound may be generated within the transport apparatus 801. The electronic device 100 may receive the generated sound via the audio reception units. At the example speed of 30 km/h, the received sound does not exceed the preset value, and the electronic device 100 may choose not to perform an operation of offsetting the generated sound.

Referring to FIG. 8B, the transport apparatus 801 may move at a speed of 100 km/h. When the transport apparatus 801 is traveling at 100 km/h, sound generated within the transport apparatus 801 may be louder than in the case of FIG. 8A. The electronic device 100 may receive the generated sound via the audio reception units. At the speed of 100 km/h, the received sound exceeds the preset value, and the electronic device 100 may perform an operation of offsetting the received sound.

The electronic device 100 may check an audio reception unit which is receiving sound louder than or equal to the preset volume; one or more of a plurality of audio reception units may receive sound louder than or equal to the preset volume.

The electronic device 100 may generate antiphase signals based on sounds having volumes of the preset value or greater that are respectively received via the plurality of audio reception units (e.g., based on whether waveforms of the received sound signals are greater (e.g., higher) than or equal in amplitude than a preset value). The electronic device 100 may convert the antiphase signals into sound waves and emit the sound waves toward the audio reception units that receive sound having the volumes equal to or greater than the preset value by using the audio output units.

When sound received via the plurality of audio reception units have lower volumes than the preset value, the electronic device 100 may cease generating antiphase signals for the received sound.

As described above, when sound received via the plurality of audio reception units has volumes greater than or equal to the preset value, the electronic device 100 may automatically perform an operation for removing the received sound.

Figure 9:
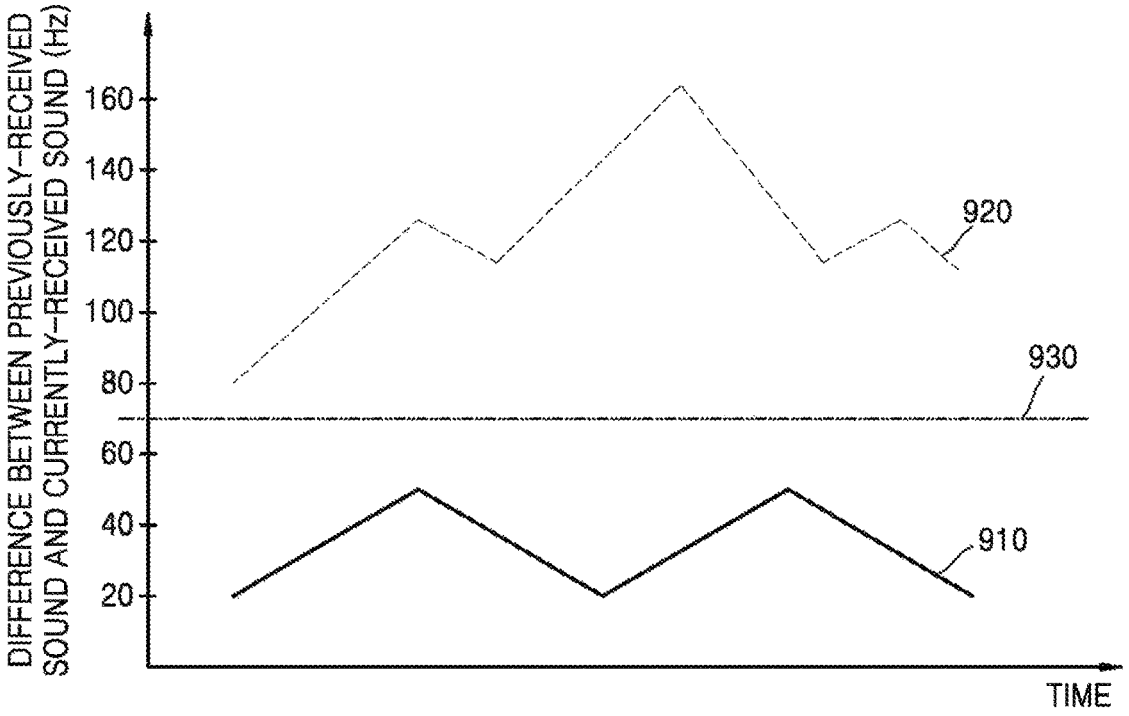
FIG. 9 is a graph illustrating when an electronic device receives sound having a different volume compared to previously-offset sound, wherein the electronic device offsets the newly received sound, according to an embodiment of the present disclosure.

FIG. 9 is a graph illustrating when the electronic device 100 receives sound having a different volume compared to previously-offset sound, wherein the electronic device 100 offsets the newly received sound, according to an embodiment of the present disclosure.

Referring to FIG. 9, the horizontal axis indicates time, and the vertical axis indicates a difference between a previously-received sound value and a currently-received sound value. The electronic device 100 may calculate a difference between sound values at time intervals of 10 μs to 100 μs. The electronic device 100 may change the time interval for calculating a difference between sound values, according to circumstances.

When the difference between the previously-received sound value and the currently-received sound value is less than or equal to a preset value, the electronic device 100 may perform an operation of offsetting the currently-received sound. Conversely, when the difference between the previously-received sound value and the currently-received sound value is greater than or equal to the preset value (e.g., a preset value 930 may be 70 hz), the electronic device 100 may choose not to perform the operation of offsetting the currently-received sound.

For example, referring to a volume change 910 of sound received by the electronic device 100, the frequency of the sound is within a range below the preset value 930, and the electronic device 100 may adaptively perform an operation of offsetting the received sound. Referring to a volume change 920 of a sound received by the electronic device 100, the frequency of the sound is within a range above the preset value 930, and the electronic device 100 may perform an operation of offsetting a previously-received sound.

For example, when the electronic device 100 is an audio device of the transport apparatus 101 or 601 and the transport apparatus 101 or 601 is in motion, sound of a certain volume may be generated within the transport apparatus 101 or 601. When sound received via an audio reception unit has a volume greater than or equal to a preset value, the electronic device 100 may perform an operation of offsetting the received sound.

While the transport apparatus 101 or 601 is moving, loud sounds, such as horns, may be introduced from transport apparatuses around the transport apparatus 101 or 601 into the transport apparatus 101 or 601. In this case, the electronic device 100 may compare the loud sounds with a previously-received sound. Because a difference between the loud sounds and the previously-received sound can exceed a preset value, the electronic device 100 may choose not to perform an operation of offsetting the loud sounds.

Figure 10:
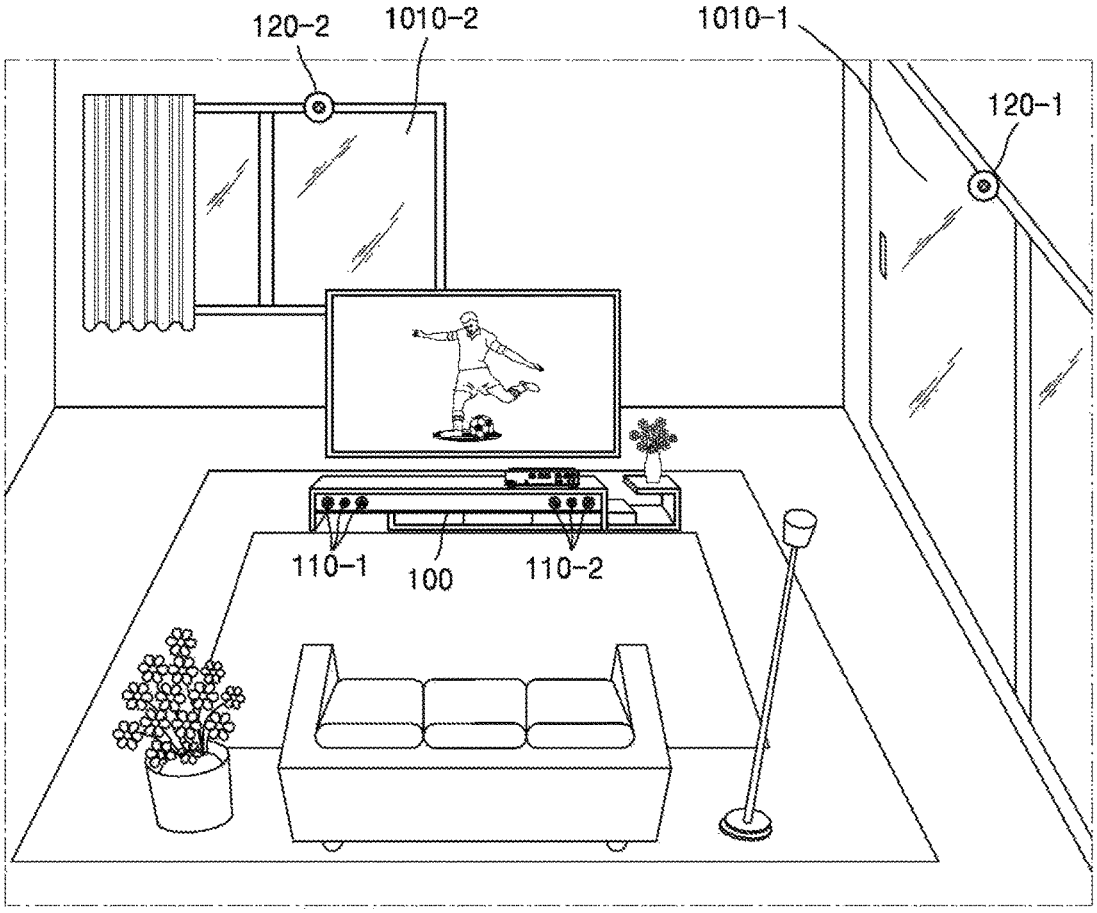
FIG. 10 is a diagram illustrating an electronic device, which removes received sound when the electronic device is mounted indoors, according to an embodiment of the present disclosure.

FIG. 10 is a diagram illustrating the electronic device 100, which removes received sound when the electronic device 100 is mounted indoors, according to an embodiment of the present disclosure.

The electronic device 100 may include an audio device disposed indoors. The audio device 100 may include a plurality of audio output units 110-1-110-2 and a plurality of audio reception units 120-1-120-2.

The electronic device 100 may receive sound source data by communicating with another electronic device (e.g., a TV, a smartphone, or a tablet) and may output the sound source data. The electronic device 100 may be a portable terminal, and the audio output units 110-1-110-2 and the audio reception units 120-1-120-2 may be disposed indoors. The electronic device 100 may communicate with the audio output units 110-1-110-2 and the audio reception units 120-1-120-2 by using various wired/wireless communication methods.

The audio reception units 120 may be mounted at various locations indoors. The audio reception units 120-1-120-2 may be mounted adjacent to first and second windows 1010-1 and 1010-2 indoors. The electronic device 100 may know the locations where the audio reception units 120-1-120-2 are mounted indoors. The audio reception units 120-1-120-2 may receive sound signals respectively generated from the locations.

The audio device 100 may generate antiphase signals of sound signals received via the audio reception units 120-1-120-2, and may emit the antiphase signals in the form of sound waves via the audio output units 120-1-120-2, as described above with reference to FIG. 4. In this case, the received sound signals may be overlapped by the antiphase signals and thus be offset.

The electronic device 100 may control the audio output unit 110-1 to output music and the audio output unit 110-2 not to output music (e.g., control the audio output unit 110-2 to output audio different from the music output by the output unit 110-1). The electronic device 100 may control directions in which the audio output units 110-1-110-2 output music or audio, by using the beam forming technique described above with reference to FIG. 5.

While the electronic device 100 is playing back music by interoperating with a TV, the first window 1010-1 may be open. In this case, the audio reception unit 120-1 adjacent to the first window 1010-1 may receive sound introduced indoors via the open first window 1010-1. The electronic device 100 may recognize that the first window 1010-1 has been opened, and may activate the audio reception unit 120-1 adjacent to the first window 1010-1.

The electronic device 100 may convert the sound received by the audio reception unit 120-1 into a digital sound signal. After extracting the digital sound signal, the electronic device 100 may generate a digital antiphase signal capable of offsetting the extracted digital sound signal. The electronic device 100 may convert the digital antiphase signals into analog antiphase signals.

The electronic device 100 may emit the digital antiphase signal in the form of a sound wave toward the audio reception unit 120-1 adjacent to the first window 1010-1, via an audio output unit. Accordingly, the sound introduced via the first window 1010-1 may be offset by the emitted sound wave.

The electronic device 100 may simultaneously or sequentially emit sound waves for offsetting sound signals respectively generated from a plurality of locations.

While the electronic device 100 is playing back music by interoperating with a TV, the first and second windows 1010-1 and 1010-2 may be simultaneously open. In this case, the audio reception units 120-1 and 120-2 adjacent to the first and second windows 1010-1 and 1010-2 may receive sound introduced indoors via the opened first and second windows 1010-1 and 1010-2. The electronic device 100 may recognize that the first and second windows 1010-1 and 1010-2 have been opened, and may activate the audio reception units 120-1 and 120-. While the electronic device 100 is receiving sound via the audio reception units 120-1 and 120-2, the electronic device 100 may recognize that sound having a preset value or greater are input when the first and second windows 1010-1 and 1010-2 are opened.

The electronic device 100 may convert the sound introduced via the audio reception unit 120-1 adjacent to the first window 1010-1 and the sound introduced via the audio reception unit 120-2 adjacent to the second window 1010-2 into digital sound signals, respectively. After extracting the digital sound signals, the electronic device 100 may generate digital antiphase signals capable of offsetting the extracted digital sound signals. The electronic device 100 may convert the digital antiphase signals into analog antiphase signals.

The electronic device 100 may emit the analog antiphase signals in the form of sound waves toward the audio reception units 120-1 and 120-2 adjacent to the first and second windows 1010-1 and 1010-2, via the audio output units 110. Accordingly, the sound introduced via the first and second windows 1010-1 and 1010-2 may be simultaneously or sequentially offset.

Figure 11:
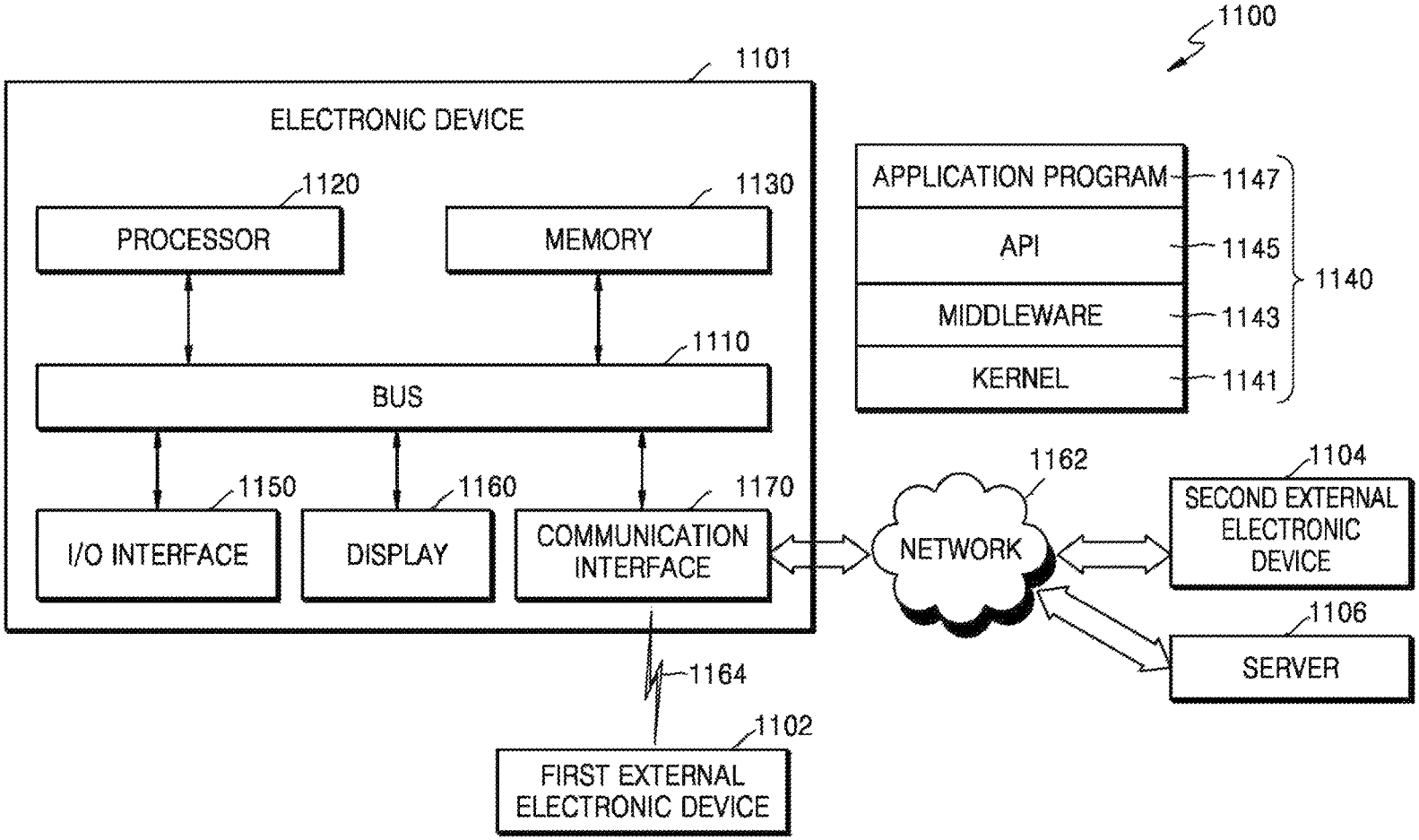
FIG. 11 is a schematic diagram of an electronic device in a network environment, according to an embodiment of the present disclosure.

FIG. 11 illustrates an electronic device 1101 within a network environment 1100, according to an embodiment of the present disclosure.

The electronic device 1101 includes a bus 1110, a processor 1120, a memory 1130, an input/output (I/O) interface 1150, a display 1160, and a communication interface 1170. The electronic device 1101 may omit at least one of the above components or may additionally include another component. The bus 1110 may connect the processor 1120, the memory 1130, the I/O interface 1150, the display 1160, and the communication interface 1170 to each other, and may include a circuit for transmitting and receiving information (e.g., a control message and/or data) to and from the processor 1120, the memory 1130, the I/O interface 1150, the display 1160, and the communication interface 1170. The processor 1120 may include at least one of a CPU, an AP, and a communication processor (CP). The processor 1120 may control at least one component of the electronic device 1101 and/or execute an operation related to communication or a data process.

The memory 1130 may include a volatile and/or nonvolatile memory. The memory 1130 may store a command or data related to at least one component of the electronic device 1101. The memory 1130 may store software and/or a program 1140. The program 1140 includes a kernel 1141, a middleware 1143, an application programming interface (API) 1145, and an application program (or an application) 1147. At least some of the kernel 1141, the middleware 1143, and the API 1145 may be referred to as an operating system (OS). The kernel 1141 may control or manage system resources (e.g., the bus 1110, the processor 1120, and the memory 1130) used to execute an operation or a function realized in other programs (e.g., the middleware 1143, the API 1145, and the application 1147). The kernel 1141 may provide an interface for controlling or managing the system resources, as the middleware 1143, the API 1145, or the application 1147 accesses individual components of the electronic device 1101.

The middleware 1143 may operate as a relay for the API 1145 or the application 1147 to communicate with the kernel 1141 to exchange data. Also, the middleware 1143 may process at least one operation request received from the application 1147 according to a priority. For example, the middleware 1143 may assign, to at least one of the application 1147, a priority of using the system resource (e.g., the bus 1110, the processor 1120, or the memory 1130) of the electronic device 1101, and may process the at least one operation request.

The API 1145 is an interface enabling the application 1147 to control functions provided by the kernel 1141 or the middleware 1143, and, may include at least one interface or function (e.g., command) for controlling a file, controlling a window, processing an image, or controlling a character.

The I/O interface 1150 may transmit a command or data input from a user or an external device to at least one of the components of the electronic device 1101, or may output a command or data received from at least one of the components of the electronic device 1101 to the user or the other external device.

The display 1160 may include a liquid crystal display (LCD), a light-emitting diode (LED) display, an organic light-emitting diode (OLED) display, a microelectromechanical systems (MEMS) display, or an electronic paper display, but is not limited thereto. The display 1160 may display various types of content (e.g., text, an image, a video, an icon, or a symbol) to the user. The display 1160 may include a touch screen, and may receive a touch, gesture, proximity, or hovering input using an electronic pen or a part of the body of the user.

The communication interface 1170 may set communication between the electronic device 1101 and a first external electronic device 1102, a second external electronic device 1104, and/or a server 1106. For example, the communication interface 1170 may communicate with the second external electronic device 1104 or the server 1106 by being connected to a network 1162 via wired communication or wireless communication.

The wireless communication may include cellular communication that uses at least one of long-term evolution (LTE), LTE advance (LTE-A), code division multiple access (CDMA), wideband CDMA (WCDMA), universal mobile telecommunications system (UMTS), wireless broadband (WiBro), and global system for mobile communications (GSM). The wireless communication may include at least one of wireless fidelity (WiFi), Bluetooth, Bluetooth low energy (BLE), Zigbee, near field communication (NFC), magnetic secure transmission, radio frequency (RF), and a body area network (BAN). The wireless communication may include a global navigation satellite system (GNSS). The GNSS may be a global positioning system (GPS), Glonass (Russian global navigation satellite system), Beidou navigation satellite system (BDS), and Galileo system (European global satellite-based navigation system). Herein, GPS and GNSS may be interchangeably used. The wired communication may include at least one of universal serial bus (USB), high definition multimedia interface (HDMI), recommended standard 232 (RS-232), power line communication, and plain old telephone service (POTS). The network 1162 may include at least one of telecommunications networks, such as a computer network (e.g., local area network (LAN) or wide area network (WAN)), the Internet, and a telephone network.

Each of the first and second external electronic devices 1102 and 1104 may be of the same or different type compared to the electronic device 1101. All or some of the operations performed by the electronic device 1101 may be performed by the first and second external electronic devices 1102 and 1104, or the server 1106. When the electronic device 1101 needs to perform a function or service automatically or upon a request, the electronic device 1101 may, instead of or in addition to executing the function or the service, request for the first or second external electronic device 1102 or 1104 or the server 1106 to perform at least some of related functions or services. The first or second external electronic device 1102 or 1104 or the server 1106 may perform a requested or additional function, and transmit a result of performing the requested or additional function to the electronic device 1101. The electronic device 1101 may provide the received result without changes or provide a requested function or service by additionally processing the received result. To this end, a cloud computing technology, a distributed computing technology, or a client-server computing technology may be used.

Electronic devices include an audio module including a plurality of audio reception units and a plurality of audio output units, and a processor electrically connected to the audio module. The processor receives sound via the plurality of audio reception units, generates antiphase signals based on the waveforms of the received sound, determines directions in which to emit the antiphase signals, based on the locations of the audio reception units, and emits the antiphase signals via the plurality of audio output units, thereby offsetting the received sound signals.

At least a part of a device (e.g., modules or functions) or a method (e.g., operations) may be realized as commands stored in a non-transitory computer-readable recording medium (e.g., the memory 1230), in a form of a program module. When the commands are executed by a processor (e.g., the processor 1210), the processor may execute functions corresponding to the commands. Examples of the non-transitory computer-readable recording medium include hard discs, floppy discs, magnetic media (e.g., magnetic tapes), optical recording media (e.g., CD-ROM and DVD), magneto-optic media (e.g., floptical discs), and embedded memory. Examples of the commands include codes prepared by a compiler, and codes executable by an interpreter. Modules or program modules may include at least one of the aforementioned components.

Some of the aforementioned components may be omitted, or other components may be further included in addition to the aforementioned components. Operations performed by modules, program modules, or other components according to various embodiments may be executed in a sequential, parallel, iterative, or heuristic manner. Also, at least some of the operations may be performed in a different order or may not be performed, or another operation may be added.

While the present disclosure has been shown and described with reference to certain embodiments thereof, it will be understood by those skilled in the art that various changes in form and details may be made therein without departing from the scope of the present disclosure. Therefore, the scope of the present disclosure should not be defined as being limited to the embodiments, but should be defined by the appended claims and equivalents thereof.

What is claimed is:

1. An electronic device which is installed in a vehicle, comprising:

an audio module including a plurality of audio reception units and a plurality of audio output units; and a processor configured to:

display a graphical user interface (GUI) including an image of the vehicle, receive a user input touching a portion of the image of the vehicle, detect an opened window of the vehicle among a plurality of windows of the vehicle, identify a position of the opened window, activating a first audio reception unit among the plurality of audio reception units based on the received user input, activating a second audio reception unit among the plurality of audio reception units based on the identified position of the opened window, receive sound via the first audio reception unit and the second audio reception unit activated among the plurality of audio reception units, generate antiphase signals based on waveforms of the received sound, determine directions in which to emit the antiphase signals, based on locations of the first audio reception unit and the second audio reception unit, and the position of the opened window, and emit the antiphase signals via a first audio output unit corresponding to the first audio reception unit and a second output unit corresponding to the second audio reception unit, wherein the processor is further configured to generate an antiphase signal with respect to sound received during a second period based on whether a difference between volume of a sound received during a first period and volume of the sound received during the second period is less than or equal to a preset value.

2. The electronic device of claim 1, wherein the plurality of audio output units change the antiphase signals to sound waves and emit the sound waves.

3. The electronic device of claim 1, wherein the processor is further configured to generate the antiphase signals corresponding to the received sound based on whether volume of the received sound is greater than or equal to a preset value.

4. The electronic device of claim 1, further comprising a display configured to receive a touch input, wherein the processor is further configured to:

activate at least one of the plurality of audio reception units based on a touch input received by the display, and generate an antiphase signal for a sound received via the activated at least one audio reception unit.

5. The electronic device of claim 1, wherein the processor is further configured to generate an antiphase signal with respect to sound received during the first period based on whether a difference between a volume of the sound received during the first period and a volume of sound received during the second period exceeds a preset value.

6. The electronic device of claim 1, wherein
wavelengths and periods of the antiphase signals are equal to wavelengths and periods of the sound received via the plurality of audio reception units, and
wherein phases of the antiphase signals are inverted compared to phases of the received sound.

7. The electronic device of claim 1, wherein the processor is further configured to determine the directions in which to emit the antiphase signals by using a beam forming method.

8. The electronic device of claim 1,
wherein the processor is further configured to:
generate a first antiphase signal based on a first sound received via the first audio reception unit,
generate a second antiphase signal based on a second sound received via the second audio reception unit,
determine a first direction in which to emit the first antiphase signal based on the location of the first audio reception unit,
determine a second direction in which to emit the second antiphase signal based on the location of the second audio reception unit, and
simultaneously emit the first antiphase signal and the second antiphase signal in the first direction and the second direction, respectively, via the plurality of audio output units.

9. The electronic device of claim 8, wherein the processor is further configured to simultaneously emit the first antiphase signal and the second antiphase signal by using a beam forming method.

10. A method of controlling an electronic device which is installed in a vehicle, the method comprising:
displaying a graphical user interface (GUI) including an image of the vehicle;
receiving a user input touching a portion of the image of the vehicle;
detecting an opened window of the vehicle among a plurality of windows of the vehicle;
identifying a position of the opened window;
activating a first audio reception unit among a plurality of audio reception units based on the received user input;
activating a second audio reception unit among the plurality of audio reception units based on the identified position of the opened window;
receiving sound via the first audio reception unit and the second audio reception unit activated among the plurality of audio reception units;
generating antiphase signals based on waveforms of the received sound;
determining directions in which to emit the antiphase signals based on locations of the first audio reception unit and the second audio reception unit, and the position of the opened window;
emitting the antiphase signals via a first audio output unit corresponding to the first audio reception unit and a second output unit corresponding to the second audio reception unit; and
generating an antiphase signal with respect to sound received during a second period based on whether a difference between volume of sound received during a first period and volume of the sound received during the second period is less than or equal to a preset value.

11. The method of claim 10, further comprising:
changing the antiphase signals to sound waves; and
emitting the sound waves toward a preset location.

12. The method of claim 10, further comprising generating the antiphase signals based on whether volume of the received sound is greater than or equal to a preset value.

13. The method of claim 10, further comprising generating an antiphase signal with respect to sound received during the first period based on whether a difference between volume of the sound received during the first period and volume of a sound received during the second period exceeds a preset value.

14. The method of claim 10, wherein determining the directions in which to emit the antiphase signals comprises using a beam forming method.

15. The method of claim 10, further comprising:
generating a first antiphase signal based on a first sound received via the first audio reception unit;
generating a second antiphase signal based on a second sound received via the second audio reception unit;
determining a first direction in which to emit the first antiphase signal based on the location of the first audio reception unit;
determining a second direction in which to emit the second antiphase signal based on the location the second audio reception unit; and
simultaneously emitting the first antiphase signal and the second antiphase signal in the first direction and the second direction, respectively.

16. The method of claim 15, further comprising simultaneously emitting the first antiphase signal and the second antiphase signal by using a beam forming method.

17. A non-transitory recording medium having stored therein commands for executing a method of controlling an electronic device which is installed in a vehicle, the method comprising:
displaying a graphical user interface (GUI) including an image of the vehicle;
receiving a user input touching a portion of the image of the vehicle;
detecting an opened window of the vehicle among a plurality of windows of the vehicle;
identifying a position of the opened window;
activating a first audio reception unit among a plurality of audio reception units based on the received user input;
activating a second audio reception unit among the plurality of audio reception units based on the identified position of the opened window;
generating antiphase signals based on waveforms of sound received via the first audio reception unit and the second audio reception unit activated among the plurality of audio reception units;
determining directions in which to emit the antiphase signals based on locations of the first audio reception unit and the second audio reception unit, and the position of the opened window;
emitting the antiphase signals via a first audio output unit corresponding to the first audio reception unit and a second output unit corresponding to the second audio reception unit; and
generating an antiphase signal with respect to sound received during a second period based on whether a difference between volume of sound received during a first period and volume of the sound received during the second period is less than or equal to a preset value.

* * * * *